US011126114B2

(12) United States Patent
Nakamoto et al.

(10) Patent No.: US 11,126,114 B2
(45) Date of Patent: Sep. 21, 2021

(54) BELT RUNNING DEVICE, TRANSFER DEVICE, AND IMAGE FORMING APPARATUS

(71) Applicants: Atsushi Nakamoto, Kanagawa (JP); Seiichi Kogure, Kanagawa (JP); Daisuke Hamada, Kanagawa (JP); Takuya Akiyama, Kanagawa (JP); Yuuki Aoki, Tokyo (JP); Yutaka Goto, Kanagawa (JP)

(72) Inventors: Atsushi Nakamoto, Kanagawa (JP); Seiichi Kogure, Kanagawa (JP); Daisuke Hamada, Kanagawa (JP); Takuya Akiyama, Kanagawa (JP); Yuuki Aoki, Tokyo (JP); Yutaka Goto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/999,453

(22) Filed: Aug. 21, 2020

(65) Prior Publication Data

US 2021/0063919 A1 Mar. 4, 2021

(30) Foreign Application Priority Data

Aug. 30, 2019 (JP) ..... JP2019-158571

(51) Int. Cl.
*G03G 15/20* (2006.01)
*G03G 15/16* (2006.01)

(52) U.S. Cl.
CPC ..... *G03G 15/1615* (2013.01)

(58) Field of Classification Search
CPC ..... G03G 15/1615; G03G 15/6567; G03G 2215/00143; G03G 15/1567;
(Continued)

(56) References Cited

U.S. PATENT DOCUMENTS 6,970,674 B2 * 11/2005 Sato ..... G03G 15/1615 198/806
7,873,311 B2 * 1/2011 Hara ..... G03G 15/1615 399/302
(Continued)

FOREIGN PATENT DOCUMENTS

JP 2004-045959 2/2004
JP 2004-075375 3/2004
(Continued)

*Primary Examiner* — Hoan H Tran
(74) *Attorney, Agent, or Firm* — Duft & Bornsen, PC

(57) ABSTRACT

A belt running device includes a plurality of rollers, a belt, a guide, a regulating member, and an abutting member. The belt is wound around the plurality of rollers and configured to rotate. The guide is provided at an end of an inner peripheral surface of the belt. The regulating member is provided at an end of at least one roller of the plurality of rollers in the axial direction of the at least one roller and configured to contact the guide and regulate a movement of the belt in the axial direction of the at least one roller. The abutting member is configured to contact an outer peripheral surface of the belt to press the belt inward in a vicinity of a contact start point at which the guide and the regulating member start to contact when the belt runs.

11 Claims, 10 Drawing Sheets

(58) Field of Classification Search
CPC ..... G03G 15/0189; G03G 2215/2035; G03G 2215/2038; G03G 2215/1623; G03G 2215/1642; G03G 2215/1661
USPC ..... 399/121, 161, 165, 297–303, 310, 313
See application file for complete search history.

(56) References Cited

U.S. PATENT DOCUMENTS

| | | | | |
|---|---|---|---|---|
| 8,351,831 | B2 * | 1/2013 | Hori ..... | G03G 15/01 399/303 |
| 2017/0242371 | A1 | 8/2017 | Kogure et al. | |
| 2018/0046115 | A1 | 2/2018 | Fujita et al. | |
| 2018/0059583 | A1 | 3/2018 | Kumagai et al. | |
| 2018/0157196 | A1 | 6/2018 | Kogure et al. | |
| 2018/0341201 | A1 | 11/2018 | Kogure et al. | |

FOREIGN PATENT DOCUMENTS

| | | |
|---|---|---|
| JP | 2006-078612 | 3/2006 |
| JP | 2013-083693 | 5/2013 |
| JP | 2018-146608 | 9/2018 |

* cited by examiner

BELT RUNNING DEVICE, TRANSFER DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-158571, filed on Aug. 30, 2019, in the Japan Patent Office, the entire disclosure of which is hereby incorporated by reference herein.

BACKGROUND

Technical Field

The present disclosure relates to a belt running device, a transfer device, and an image forming apparatus.

Description of the Related Art

There is known a belt running device in which an endless belt such as an intermediate transfer belt or a secondary transfer belt is wound around a plurality of rollers to rotate (run) the belt. In such a device, if there is a difference in the outer diameter of a roller or the circumferential length of the belt in the axial direction of the roller, the belt may meander when the roller is driven to rotate the belt.

Hence, there have been proposed, for example, a technique in which flanges are provided at both ends of a roller and a guide roller that abuts against an edge of a belt is provided, and a technique in which tapered portions are provided at both ends of a roller and a pressing member to press the belt is provided outside the tapered portion. There has also been proposed a technique in which a belt-shaped guide at an end of an inner peripheral surface of a belt and regulating members at both ends of a roller are provided to prevent the belt from meandering.

SUMMARY

In an aspect of the present disclosure, a belt running device includes a plurality of rollers, a belt, a guide, a regulating member, and an abutting member. The belt is wound around the plurality of rollers and configured to rotate. The guide is provided at an end of an inner peripheral surface of the belt. The regulating member is provided at an end of at least one roller of the plurality of rollers in the axial direction of the at least one roller and configured to contact the guide and regulate a movement of the belt in the axial direction of the at least one roller. The abutting member is configured to contact an outer peripheral surface of the belt to press the belt inward in a vicinity of a contact start point at which the guide and the regulating member start to contact when the belt runs.

In another aspect of the present disclosure, there is provided a transfer device that includes the belt running device. The belt is a transfer belt configured to bear a toner image onto the outer peripheral surface of the transfer belt.

In still another aspect of the present disclosure, there is provided a transfer device that includes the belt running device. The belt is a secondary transfer belt configured to contact a toner image bearing surface of an intermediate transfer belt, which is configured to bear a toner image on an outer circumferential surface of the intermediate transfer belt, to form a transfer nip.

In still another aspect of the present disclosure, there is provided an image forming apparatus that includes the belt running device or the transfer device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
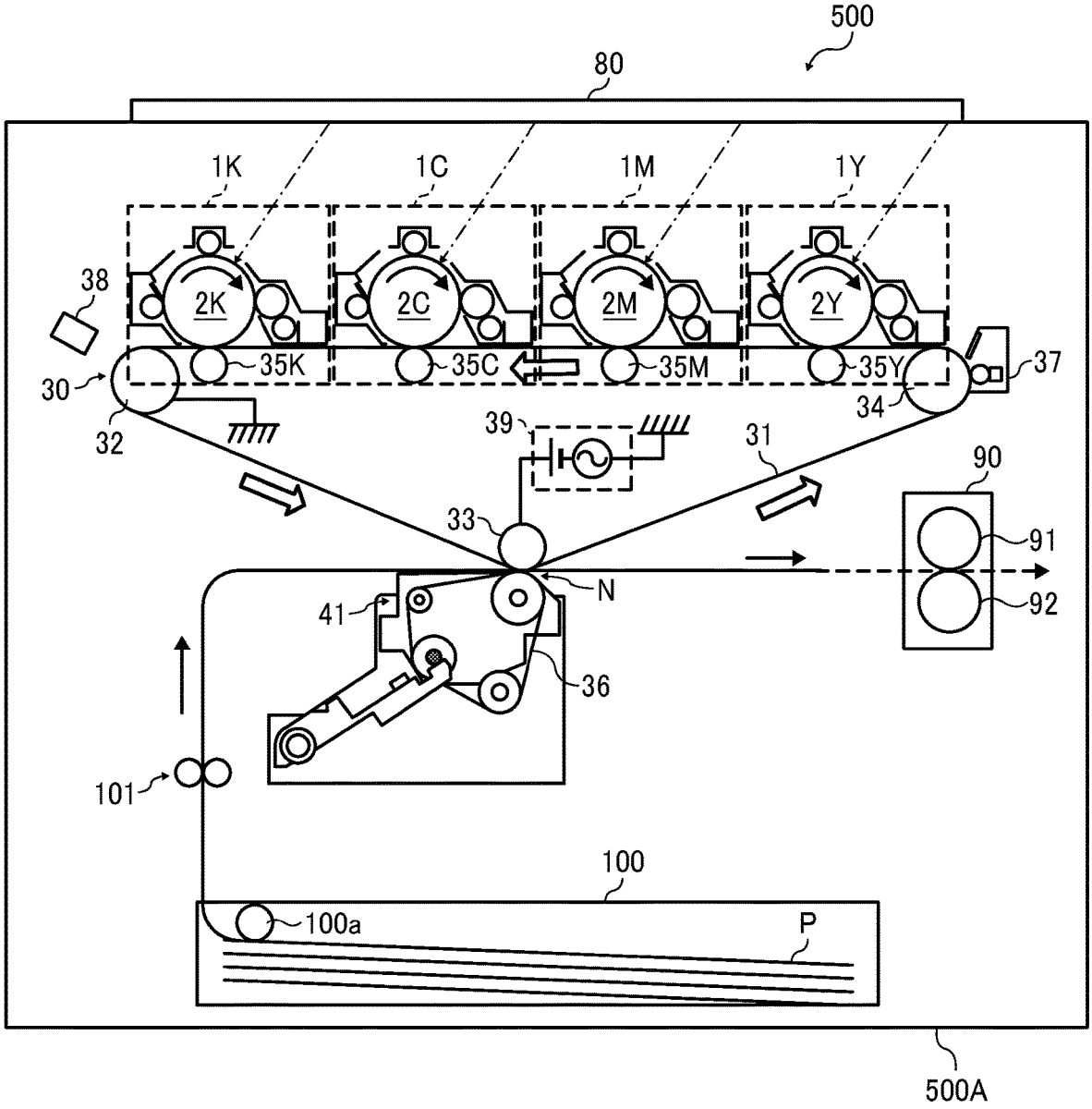
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

In a belt running device in which an endless belt such as an intermediate transfer belt or a secondary transfer belt is wound around a plurality of rollers to rotate (run) the belt, if there is a difference in the outer diameter of a roller or the circumferential length of the belt in the axial direction of the roller, the belt may meander when the roller is driven to rotate the belt. Hence, for example, there has been proposed a technique in which a belt-shaped guide at an end of an inner peripheral surface of a belt and regulating members at both ends of a roller are provided to prevent the belt from meandering. However, even when such a technology is applied, as the running speed of the belt increases, the amount of movement of the belt in the width direction also increases. For this reason, in the device provided with the guide and the regulating members as described above, the guide may ride on the regulating member, and the belt may be broken or a good quality image may not be transferred to a recording medium. Further, the guide and the regulating members may rub against each other to be scraped, and shavings may enter an inner peripheral portion of the belt to cause a partial transfer failure or a cleaning failure of residual toner remaining on the belt to stain the recording medium.

Figure 15A:
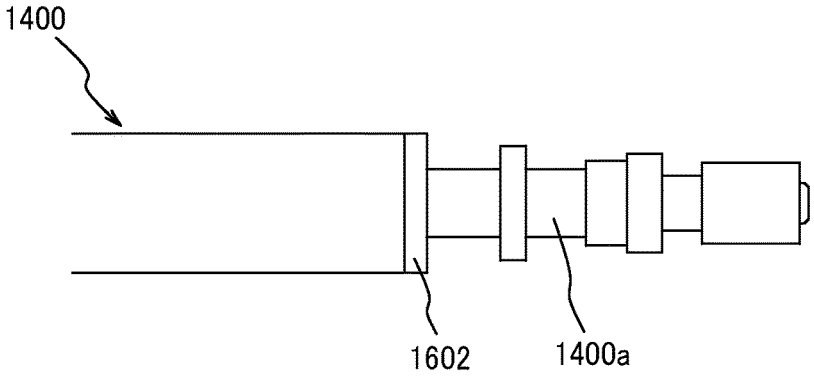
FIGS. 15A and 15B are schematic views of a driving roller in the secondary transfer unit.
Figure 15B:
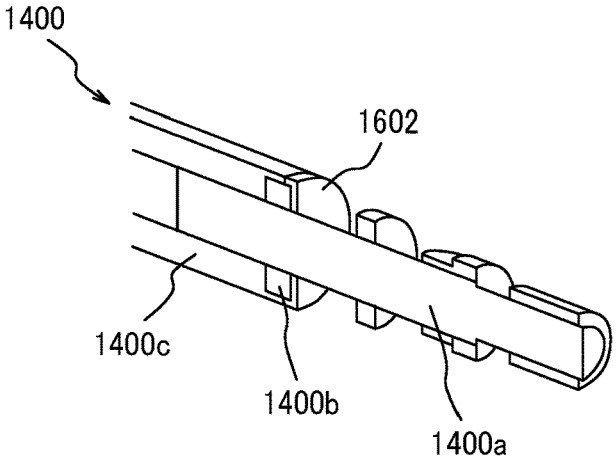

This point is described with reference to comparative examples illustrated in FIGS. 15A, 15B, 16A, and 16B. FIGS. 15A and 15B illustrate a driving roller 1400 in a secondary transfer unit. FIG. 15A is a schematic side view of an end portion of the driving roller 1400, and FIG. 15B is a schematic perspective view of a cross section of the end portion of the driving roller 1400. The driving roller 1400 includes a bearing 1400*c* between a shaft 1400*a* and a roller body 1400*b*, and the roller body 1400*b* is rotatably provided around the shaft 1400*a*. A collar having an annular shape and functioning as a regulating member 1602 is provided at an end of the roller body 1400*b*.

Figure 16A:
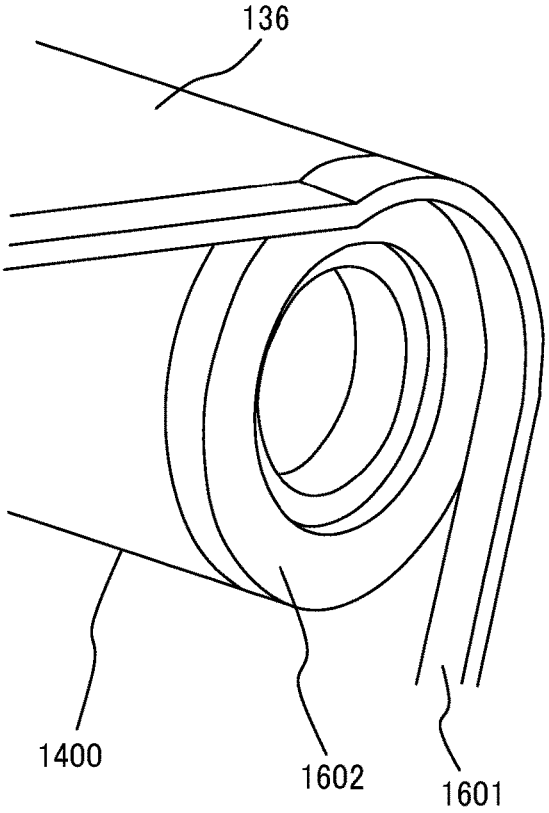
FIGS. 16A and 16B are schematic views of a state in which the guide rides on the regulating member.
Figure 16B:
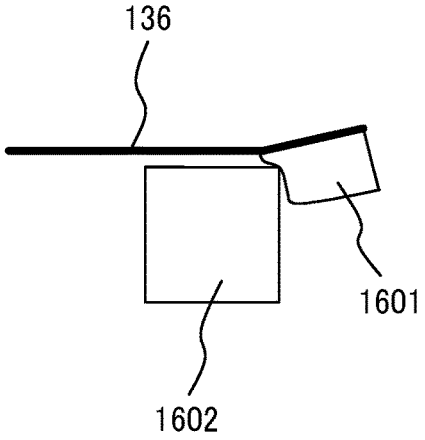

FIGS. 16A and 16B are schematic views of the vicinity of the driving roller 1400 in the secondary transfer unit. Here, FIG. 16A is a schematic perspective view of the vicinity of the driving roller 1400 with the shaft 1400*a* (illustrated in FIGS. 15A and 15B) omitted. FIG. 16B is a schematic view of a state in which a secondary transfer belt 136, which is an embodiment of the belt, meanders and a guide 1601 provided on the inner peripheral surface of the secondary transfer belt 136 rides on the regulating member 1602. When the guide 1601 rides on the regulating member 1602 in this manner, the secondary transfer belt 136 is bent in a vicinity of the inner edge of the guide 1601 as illustrated in FIGS. 16A and 16B, and thus the secondary transfer belt 136 may be broken or an image may not be satisfactorily transferred to a recording medium undesirably. Further, in this state, since the outer edge of the regulating member 1602 and the inner edge of the guide 1601 rub against each other, both the outer edge of the regulating member 1602 and the inner edge of the guide 1601 are scraped to generate shavings, and a transfer failure or the like may occur due to the shavings as described above.

As described below, according to at least one embodiment of the present disclosure, an abutting member contacting the outer peripheral surface of a belt is disposed to press the belt inwardly in the vicinity of a contact start point at which a guide and a regulating member start to contact. Such a configuration can regulate, at the contact start point, the guide from riding on the regulating member when the belt meanders.

Hereinafter, an image forming apparatus according an embodiment of the present disclosure is described with reference to the accompanying drawings. FIG. 1 is a schematic view of an electrophotographic color printer 500 (hereinafter referred to as "printer") as an image forming apparatus according to an embodiment of the present disclosure. Note that the image forming apparatus according to the present disclosure is not limited to a printer, and may be a single copying machine or a facsimile machine, or a multifunction machine having at least two or more functions among a printer, a copying machine, a facsimile machine, a scanner, and the like.

First, a description is given of a basic configuration of the printer 500 according to the present embodiment. In FIG. 1, the printer 500 includes four image forming units 1Y, 1M, 1C, and 1K to form toner images of yellow (Y), magenta (M), cyan (C), and black (K), respectively. The printer 500 also includes a transfer unit 30, an optical writing unit 80, a fixing device 90, a sheet feeding cassette 100, and a registration roller pair 101. The transfer unit 30 is a transfer device according to an embodiment of the present disclosure. The optical writing unit 80 is an exposure device. The four image forming units 1Y, 1M, 1C, and 1K use toner, which is powder of different colors of Y, M, C, and K as developers. However, the four image forming units have the same configuration except for the colors of toner, and are replaced at the end of the product lives. That is, the four image forming units 1Y, 1M, 1C, and 1K are removably mounted in an apparatus body 500A as a body of the image forming apparatus and are replaceable.

Figure 2:
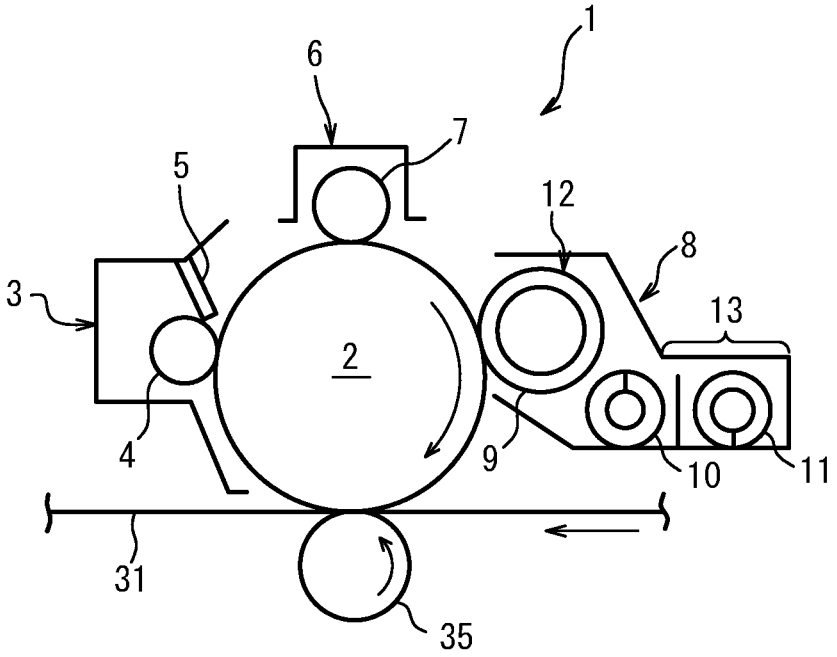
FIG. 2 is a diagram of a schematic configuration of an image forming unit of the image forming apparatus.

FIG. 2 is an enlarged schematic view of one of the four image forming units 1Y, 1M, 1C, and 1K. Since the four image forming units 1Y, 1M, 1C, and 1K have the same configuration except that the colors of toner to be used are different, suffixes (Y, M, C, and K) indicating the colors of toner to be used are omitted. The image forming unit 1 includes a drum-shaped photoconductor 2 as an image bearer, a drum cleaner 3, a charge remover, a charger 6, a developing device 8, and the like. The image forming unit 1 constitutes a process cartridge unit in which such a plurality of devices are held by a common holding member. The process cartridge unit is integrally attachable to and detachable from the printer body 500A and is replaceable as a single unit.

The photoconductor 2 has a drum shape in which an organic photosensitive layer is formed on a surface of a drum base, and is rotationally driven in a clockwise direction in FIG. 2 by a driving device. The charger 6 causes electric discharge between the charging roller 7 and the photoconductor 2 while bringing the charging roller 7, which is a charging member to which a charging bias is applied, into contact with or close to the photoconductor 2. Thus, the charger 6 uniformly charges a surface of the photoconductor 2. Instead of the method of bringing the charging member such as the charging roller into contact with or close to the photoconductor 2, a method using an electric charger may be employed. The surface of the photoconductor 2 uniformly charged by the charging roller 7 is optically scanned by exposure light such as laser beam emitted from the optical writing unit 80 described later, and bears an electrostatic latent image for each color. The electrostatic latent image is developed into a toner image of each color by the developing device 8 using toner of each color. The toner image on the photoconductor 2 is primarily transferred onto a surface (toner image bearing surface) of an intermediate transfer belt 31 formed of an endless belt described later.

A drum cleaner 3 removes residual transfer toner adhering to the surface of the photoconductor 2 after a primary transfer process (in a primary transfer nip described later). The drum cleaner 3 includes a cleaning brush roller 4, a cleaning blade 5, and the like. The cleaning brush roller 4 is rotationally driven. The cleaning blade 5 is supported in a cantilever manner and has a free end that contacts with the photoconductor 2. The drum cleaner 3 scrapes off the residual transfer toner from the surface of the photoconductor 2 by the rotating cleaning brush roller 4, and scrapes off the residual transfer toner from the surface of the photoconductor 2 by the cleaning blade 5 to clean the surface of the photoconductor 2.

The charge remover removes residual charge of the photoconductor 2 after the photoconductor 2 is cleaned by the drum cleaner 3. As a result of the charge removal, the surface of the photoconductor 2 is initialized to prepare for a next image formation.

The developing device 8 includes a developing portion 12 and a developer conveying portion 13. The developing portion 12 includes a developing roller 9 serving as a developer bearing member. The developer conveying portion 13 stirs and conveys a developer. The developer conveying portion 13 includes a first conveyance chamber that accommodates a first screw member 10 and a second conveyance chamber that accommodates a second screw member 11. The first screw member 10 and the second screw member 11 are rotatably supported by a case of the developing device 8 or the like. The first screw member 10 and the second screw member 11 are driven to rotate, thereby conveying the developer while circulating the developer to supply the developer to the developing roller 9.

As illustrated in FIG. 1, the optical writing unit 80 serving as a latent image writing device is disposed above the image forming units 1Y, 1M, 1C, and 1K. The optical writing unit 80 optically scans the photoconductors 2Y, 2M, 2C, and 2K with laser beams emitted from a laser diode based on image information sent from an external device such as a personal computer. By the optical scanning, electrostatic latent images for Y, M, C, and K are formed on the photoconductors 2Y, 2M, 2C, and 2K, respectively.

Below the image forming units 1Y, 1M, 1C, and 1K, the transfer unit 30 is disposed to endlessly move the endless intermediate transfer belt 31 in a counterclockwise direction in FIG. 1 while stretching the intermediate transfer belt 31. The transfer unit 30 includes, in addition to the intermediate transfer belt 31 serving as an image bearer, a driving roller 32, a secondary transfer back surface roller 33, a cleaning backup roller 34, and four primary transfer rollers 35Y, 35M, 35C, and 35K as a plurality of rotating members. The whole transfer unit 30 is detachable (replaceable) from the printer body 500A. A secondary transfer unit 41, a belt cleaner 37, a potential sensor 38, and the like are disposed around the outside of the loop of the intermediate transfer belt 31. The secondary transfer unit 41 (as a transfer device according to an embodiment of the present disclosure) includes a secondary transfer belt 36 as a second transfer member. The potential sensor 38 is a detection device.

The intermediate transfer belt 31 is wound around, supported and stretched by the driving roller 32, the secondary transfer back surface roller 33, the cleaning backup roller 34, and the four primary transfer rollers 35Y, 35M, 35C, and 35K. The driving roller 32, the secondary transfer back surface roller 33, the cleaning backup roller 34, and the four primary transfer rollers 35Y, 35M, 35C, and 35K are disposed inside the loop of the intermediate transfer belt 31. The driving roller 32 is rotationally driven in the counterclockwise direction in FIG. 1 by a driving device. The intermediate transfer belt 31 is endlessly moved and conveyed by the rotational force of the driving roller 32 in the same direction. That is, the transfer unit 30 winds and supports the intermediate transfer belt 31 around a plurality of rotating bodies to convey the intermediate transfer belt 31.

The four primary transfer rollers 35Y, 35M, 35C, and 35K sandwich the intermediate transfer belt 31, which is endlessly moved, between the primary transfer rollers 35Y, 35M, 35C, and 35K and the photoconductors 2Y, 2M, 2C, and 2K, respectively. Thus, the four primary transfer rollers 35Y, 35M, 35C, and 35K form primary transfer nips, which are transfer portions for Y, M, C, and K, at which the front surface of the intermediate transfer belt 31 contacts the photoconductors 2Y, 2M, 2C, and 2K. A primary transfer bias is applied to each of the primary transfer rollers 35Y, 35M, 35C, and 35K by a transfer bias power source. Accordingly, transfer electric fields are generated between the primary transfer rollers 35Y, 35M, 35C, and 35K, and the toner images of yellow, magenta, cyan, and black on the photoconductors 2Y, 2M, 2C, and 2K, respectively.

For example, a toner image of yellow formed on the surface of the photoconductor 2Y enters the primary transfer nip for yellow as the photoconductor 2Y rotates. Then, the transfer electric field and the nip pressure act to primarily transfer the toner image from the photoconductor 2Y for yellow onto the intermediate transfer belt 31. Thereafter, the intermediate transfer belt 31 onto which the toner image for Y has been primarily transferred in this manner sequentially passes through the primary transfer nips for M, C, and K. Then, a magenta toner image, a cyan toner image, and a black toner image on the photoconductors 2M, 2C, and 2K are primarily transferred and sequentially superimposed on the yellow toner image. Accordingly, a composite toner image, in which the toner images of four colors are superimposed, is formed on the intermediate transfer belt 31 in the primary transfer process. Instead of the primary transfer rollers 35Y, 35M, 35C, and 35K, a transfer charger or a transfer brush may be used as the primary transfer member.

The secondary transfer unit 41 disposed outside the loop of the intermediate transfer belt 31 sandwiches the intermediate transfer belt 31 between the secondary transfer unit 41 and the secondary transfer back surface roller 33 disposed inside the loop of the intermediate transfer belt 31 to form a secondary transfer nip N. The secondary transfer nip N serves as a transfer portion in which a front surface of the intermediate transfer belt 31 and the secondary transfer belt 36 contact each other. A secondary transfer bias is applied to the secondary transfer back surface roller 33 by a secondary transfer bias power source 39. Accordingly, a secondary transfer electric field is formed between the secondary transfer back surface roller 33 and the secondary transfer belt 36 to electrostatically move the toner having the negative polarity from the secondary transfer back surface roller 33 toward the secondary transfer belt 36.

Below the transfer unit 30 is disposed the sheet feeding cassette 100 serving as a storage unit that stores a plurality of stacked recording media P such as sheets or resin sheets in a state of a bundle of media. In the sheet feeding cassette 100, a roller 100*a* is in contact with an uppermost recording medium P of the bundle of media, and is rotationally driven at a predetermined timing to feed the recording medium P toward a conveyance path. The registration roller pair 101 is disposed near an end of the conveyance path. The registration roller pair 101 stops the rotation of both rollers immediately after the recording medium P fed from the sheet feeding cassette 100 is nipped between the rollers of the registration roller pair 101. The rotation drive of the registration roller pair 101 is resumed at a timing at which the nipped recording medium P can be synchronized with the four-color superimposed toner image on the intermediate transfer belt 31 in the secondary transfer nip N, and the recording medium P is fed toward the secondary transfer nip N. The transfer unit 30 is a belt unit that includes the intermediate transfer belt 31, the driving roller 32, the secondary transfer back surface roller 33, and the cleaning backup roller 34. The intermediate transfer belt 31 is as an endless belt to which a toner image that becomes an image is transferred. The intermediate transfer belt 31 is wound around and supported by the driving roller 32, the secondary transfer back surface roller 33, and the cleaning backup roller 34 serving as the plurality of rotating members. The toner image that has been transferred to the intermediate transfer belt 31 is conveyed to the secondary transfer nip N serving as the transfer portion for the recording medium P.

The four-color superimposed toner image on the intermediate transfer belt 31 is brought into close contact with the recording medium P at the secondary transfer nip N and is collectively secondarily transferred onto the recording medium P by the action of the secondary transfer electric field and the nip pressure. The four-color toner image becomes a full-color toner image in cooperation with white color of the recording medium P. On the intermediate transfer belt 31 after the intermediate transfer belt 31 passes through the secondary transfer nip N, residual transfer toner that has not been transferred onto the recording medium P is attached. The residual transfer toner is cleaned from the surface of intermediate transfer belt 31 by the belt cleaner 37 that is in contact with the front surface of the intermediate transfer belt 31. The cleaning backup roller 34 disposed inside the loop of the intermediate transfer belt 31 supports cleaning of the intermediate transfer belt 31 by the belt cleaner 37 from the inside of the loop.

The potential sensor 38 is disposed outside the loop of the intermediate transfer belt 31. The potential sensor 38 is disposed to face a portion of the intermediate transfer belt 31 wound around the driving roller 32 with a gap therebetween in the entire surface of the circumferential direction of the intermediate transfer belt 31. The potential sensor 38 measures a surface potential of the toner image when the toner image primarily transferred onto the intermediate transfer belt 31 enters a position opposite to the potential sensor 38.

The fixing device 90 is disposed on the right side of the secondary transfer nip N in FIG. 1. The recording medium P onto which the full-color toner image has been transferred is fed into the fixing device 90. The recording medium P fed into the fixing device 90 is nipped in a fixing nip in which a fixing roller 91 having a heat source therein contacts a pressure roller 92. The toner in the full-color toner image is softened and fixed by heating and pressing. The recording medium P after the fixing is ejected from the fixing device 90, passes through a post-fixing conveyance path, and is ejected to the outside of the printer body 500A.

The printer 500 according to the present embodiment can also form a monochrome image. In this case, a support plate of the transfer unit 30 supporting the primary transfer rollers 35Y, 35M, and 35C for yellow, magenta, and cyan, respectively, in the transfer unit 30 is moved to move the primary transfer rollers 35Y, 35M, and 35C away from the photoconductors 2Y, 2M, and 2C, respectively. Accordingly, the front surface of the intermediate transfer belt 31 is separated from the photoconductors 2Y, 2M, and 2C, and the intermediate transfer belt 31 is in contact with only the photoconductor 2K for black. In this state, among the four image forming units 1Y, 1M, 1C, and 1K, only the image forming unit 1K for black is driven to form a toner image on the photoconductor 2K for black.

In the printer 500, a roller-shaped secondary transfer roller may be used as a transfer member that forms a secondary transfer nip between the intermediate transfer belt 31 and the secondary transfer roller. A position to which the second transfer bias is applied may be on the transfer member (for example, the secondary transfer roller) instead of on the secondary transfer back surface roller 33 inside the intermediate transfer belt 31. The embodiments of the present disclosure may be applied not only to a color image forming apparatus, but also to a monochrome image forming apparatus that forms a monochrome image.

Figure 3A:
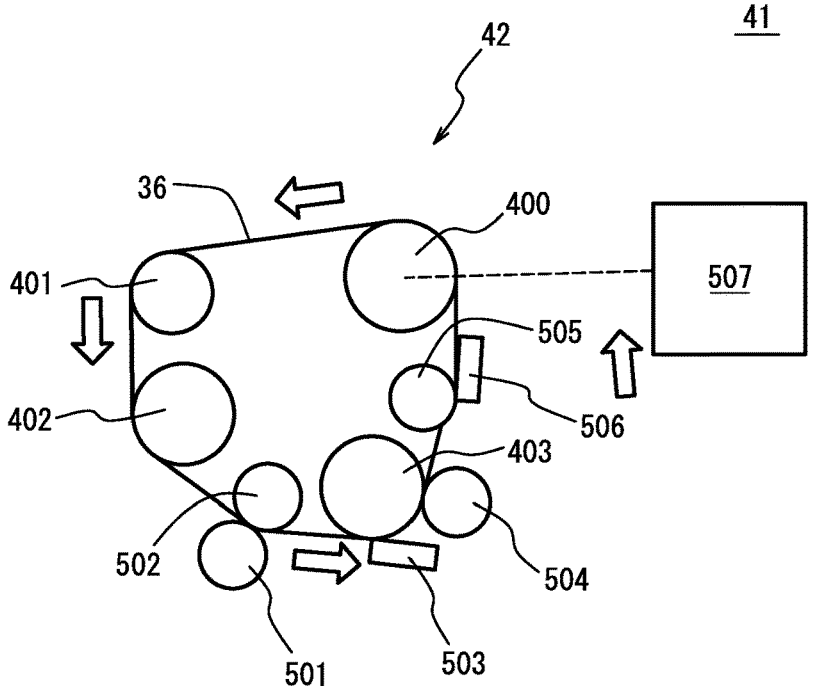
FIGS. 3A and 3B are diagrams of a schematic configuration of a belt running device constituting a secondary transfer unit.
Figure 3B:
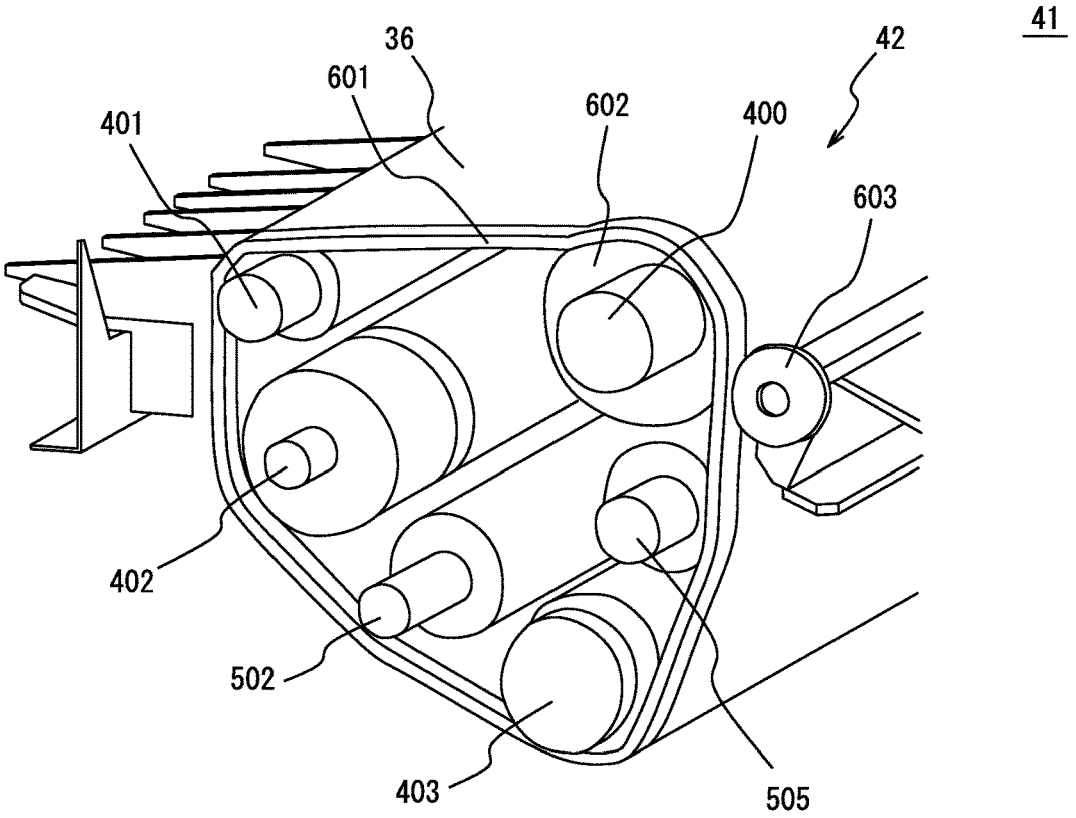

Next, the belt running device 42 constituting the secondary transfer unit 41 is described in detail with reference to FIGS. 3A and 3B. FIG. 3A is a schematic side view of the secondary transfer unit 41, and FIG. 3B is a perspective view thereof. The primary configuration of the secondary transfer unit 41 illustrated in FIGS. 3A and 3B is equivalent to the configuration illustrated in FIG. 1, but the details are changed. In FIG. 1, the recording medium P fed by the registration roller pair 101 moves from left to right in the drawing, but in FIG. 3A, the recording medium P moves from right to left.

The secondary transfer unit 41 includes the secondary transfer belt 36 as a belt according to an embodiment of the present disclosure. Inside the secondary transfer belt 36, six rollers (a driving roller 400, a separation roller 401, a driven roller 402, a brush facing roller 502, a first blade facing roller 403, and a second blade facing roller 505) are provided as a plurality of rollers according to an embodiment of the present disclosure.

The secondary transfer belt 36 is an endless belt stretched and supported by the above-described six rollers (the driving roller 400, the separation roller 401, the driven roller 402, the brush facing roller 502, the first blade facing roller 403, and the second blade facing roller 505). The secondary transfer belt 36 contacts the intermediate transfer belt 31 to form the secondary transfer nip N serving as the transfer portion, and conveys the recording medium P fed from the secondary transfer nip N. A brush roller 501, a first blade 503, a lubricant application roller 504, a second blade 506, and an abutting member 603 illustrated in FIG. 3B are provided outside the secondary transfer belt 36.

The driving roller 400 and the secondary transfer back surface roller 33 illustrated in FIG. 1 sandwich the secondary transfer belt 36 and the intermediate transfer belt 31 to form the secondary transfer nip N. The driving roller 400 is rotationally driven by a driving source 507 such as a motor in the counterclockwise direction in FIG. 3A to rotate (run) the secondary transfer belt 36 in the counterclockwise direction. The driving source 507 can change the number of rotations per minute, and can change the number of rotations per minute of the secondary transfer belt 36 (running speed of the secondary transfer belt 36). As the secondary transfer belt 36 runs, other rollers of the secondary transfer unit 41 that contact the secondary transfer belt 36 are driven to rotate.

The separation roller 401 is disposed downstream of the secondary transfer nip N in the running direction of the secondary transfer belt 36. The recording medium P sent out from the secondary transfer nip N is conveyed along the secondary transfer belt 36 running in the counterclockwise direction in FIG. 3A, and then separated from the secondary transfer belt 36 at the position of the separation roller 401 by the secondary transfer belt 36 having a curved surface formed along the outer periphery of the separation roller 401.

The driven roller 402 is disposed downstream of the separation roller 401 in the running direction of the secondary transfer belt 36. The driven roller 402 is used to measure the toner density on the secondary transfer belt 36.

The brush facing roller 502 is provided to face the brush roller 501 provided outside the secondary transfer belt 36 at a position downstream of the separation roller 401 in the running direction of the secondary transfer belt 36.

The brush roller 501 is a roller to which a cleaning bias having a polarity opposite to the toner polarity is applied to remove the toner adhering to the surface of the secondary transfer belt 36.

The first blade facing roller 403 is provided to face the first blade 503 and the lubricant application roller 504 at a position downstream of the brush facing roller 502 in the running direction of the secondary transfer belt 36. The first blade facing roller 403 is a roller that applies tension to the secondary transfer belt 36.

The first blade 503 is in contact with a surface of the secondary transfer belt 36 to remove foreign matter such as toner and paper dust attached to the surface of the secondary transfer belt 36.

The lubricant application roller 504 applies a lubricant to the surface of the secondary transfer belt 36 to reduce wear of the first blade 503 and the like.

The second blade facing roller 505 is provided to face the second blade 506 at a position downstream of the first blade facing roller 403 in the running direction of the secondary transfer belt 36.

The second blade 506 is in contact with the surface of the secondary transfer belt 36 to thin the lubricant applied to the surface of the secondary transfer belt 36.

Figure 4:
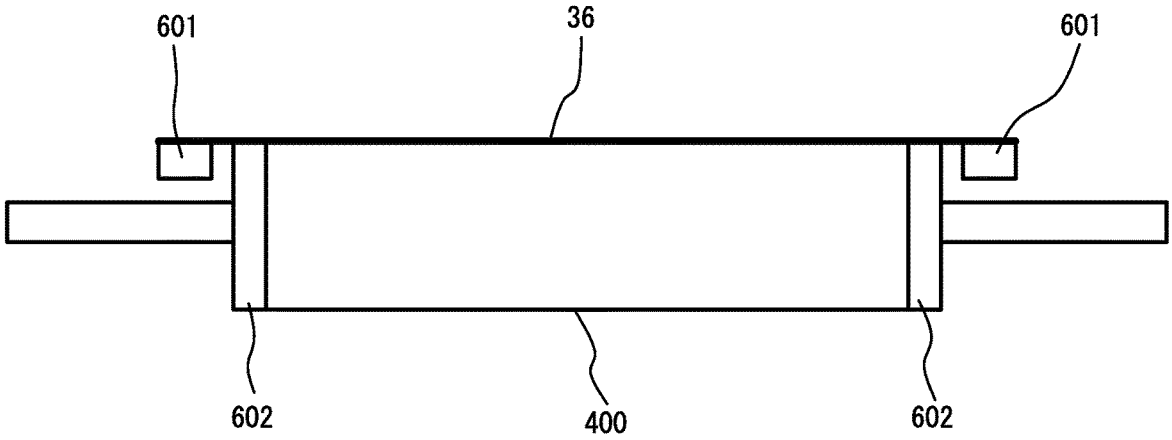
FIG. 4 is a schematic view of guides and regulating members.

If there is a difference in the outer diameter of the driving roller 400 in the axial direction of the driving roller 400 or a difference in the circumferential length of the secondary transfer belt 36 in the width direction of the secondary transfer belt 36, the secondary transfer belt 36 may move (meander) in the width direction when the secondary transfer belt 36 runs. To prevent such meandering of the secondary transfer belt 36, in the secondary transfer unit 41 of the present embodiment, as illustrated in FIG. 4, belt-shaped guides 601 formed of, for example, rubber are provided at both ends of the inner circumferential surface of the secondary transfer belt 36. Regulating members 602 are provided at both ends of the driving roller 400 in the axial direction. Each of the regulating members 602 is constituted by, for example, a flange integrated with the driving roller 400 or a collar which is a member different from the driving roller 400. The regulating members 602 may have a diameter different from the diameter of the driving roller 400. Further, although the regulating member 602 in the illustrated example is constituted by a collar that is a separate member having substantially the same diameter as the driving roller 400, the regulating member 602 may be constituted by an end itself of the driving roller 400. According to the guide 601 and the regulating member 602, when the secondary transfer belt 36 meanders, an inner edge portion of the guide 601 comes into contact with an outer edge portion of the regulating member 602, and the movement of the secondary transfer belt 36 in the width direction is regulated.

Figure 5A:
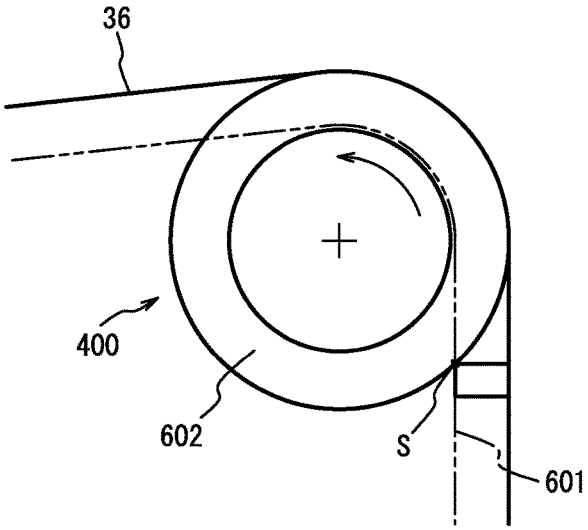
FIGS. 5A and 5B are diagrams of a schematic configuration of a phenomenon in which the guide rides on the regulating member.
Figure 5B:
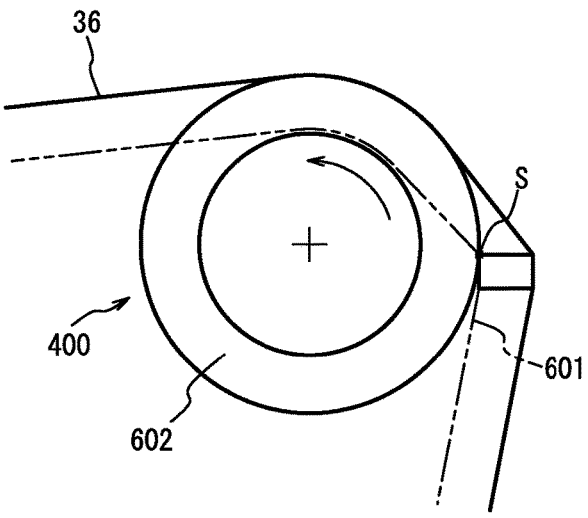

In a case in which the guide 601 and the regulating member 602 are provided, the guide 601 may ride on the regulating member 602. This point is described with reference to FIGS. 5A and 5B. FIGS. 5A and 5B are views of a periphery of the driving roller 400 in the secondary transfer unit 41 viewed from a rotation axis direction of the driving roller 400. The guide 601 is provided on the entire inner circumferential surface of the secondary transfer belt 36 as indicated by a two-dot chain line in FIGS. 5A and 5B. However, in FIGS. 5A and 5B, attention is paid to a part of the secondary transfer belt 36 in the circumferential direction, and the part is indicated by a solid line.

When the inner edge portion of the guide 601 comes into contact with the outer edge portion of the regulating member 602, as illustrated in FIG. 5A, the guide 601 comes into contact with the regulating member 602 from upstream in the running direction of the secondary transfer belt 36. Here, a portion in which the guide 601 contacts the regulating member 602 is referred to as a contact start point S. If the contact friction between the guide 601 and the regulating member 602 is small when the guide 601 comes into contact with the regulating member 602, the guide 601 does not ride on the regulating member 602. On the other hand, when the contact friction between the guide 601 and the regulating member 602 is increased, the guide 601 is slightly moved by the regulating member 602 in a direction in which the 601 rides on the regulating member 602 (radially outward of the driving roller 400) and then returned to an original position (hereinafter, the movement of the guide 601 moving radially outward or inward of the driving roller 400 is referred to as pulsation). When the contact friction between the guide 601 and the regulating member 602 is further increased, the guide 601 largely moves outward in the radial direction of the driving roller 400, and rides on the regulating member 602 as illustrated in FIG. 5B. As described above, as the magnitude of the contact friction between the guide 601 and the regulating member 602 increases, the state of the guide 601 generally shifts to a state in which the guide 601 does not pulsate, a state in which the guide 601 pulsates, and a state in which the guide 601 rides on the regulating member 602.

The contact friction between the guide 601 and the regulating member 602 is also affected by the running speed of the secondary transfer belt 36. When the running speed of the secondary transfer belt 36 increases, the amount of movement of the secondary transfer belt 36 in the width direction also tends to increase. Accordingly, the contact friction between the guide 601 and the regulating member 602 also increases. Therefore, when the running speed of the secondary transfer belt 36 increases, the guide 601 pulsates or the guide 601 rides on the regulating member 602.

Figure 6:
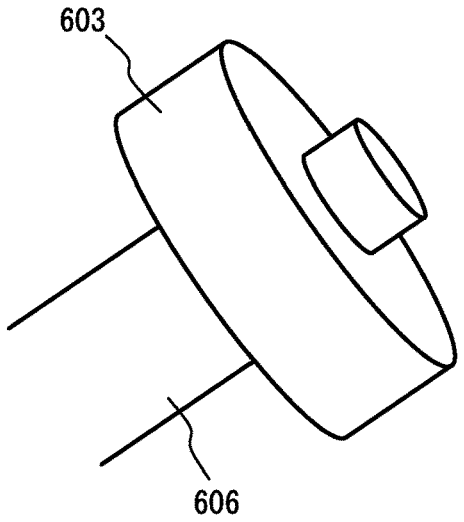
FIG. 6 is a schematic perspective view of an abutting member.

In the present embodiment, the abutting member 603 is provided to solve such a problem. As illustrated in FIG. 6, the abutting member 603 has a cylindrical shape (roller shape) and is rotatably held by a column-shaped holding member 606.

Figure 7A:
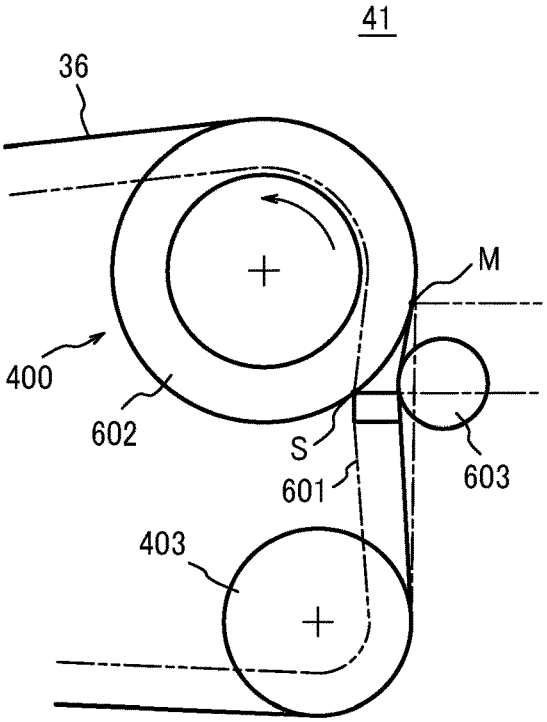
FIGS. 7A and 7B are diagrams of the guide, the regulating member, and the abutting member.
Figure 7B:
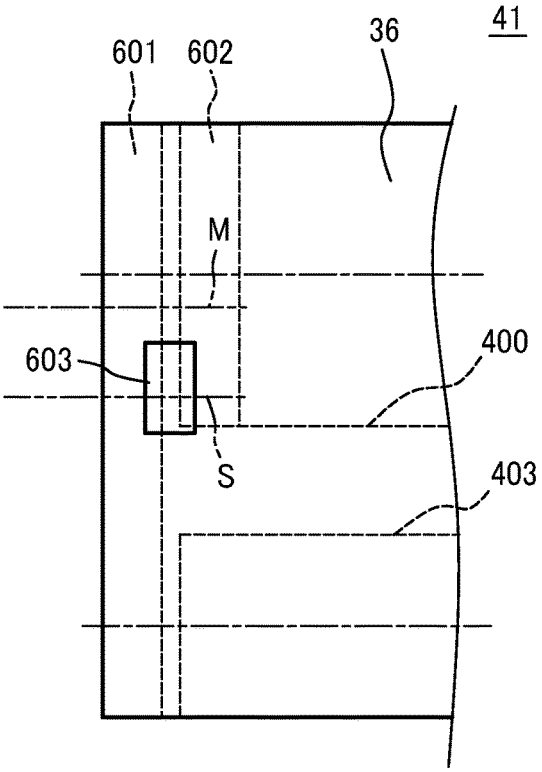
Figure 8:
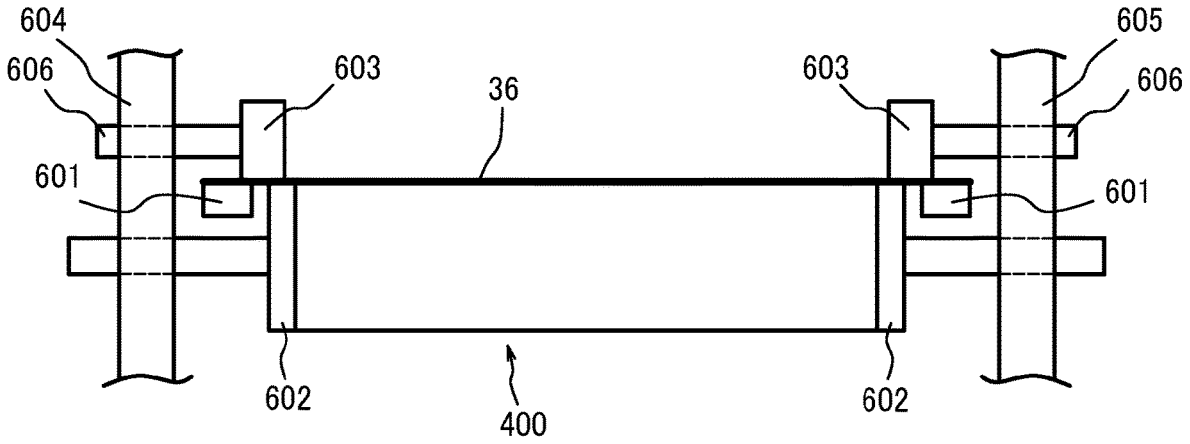
FIG. 8 is a diagram of the guide, the regulating member, and the abutting member.

As illustrated in FIGS. 7A, 7B and 8, the abutting members 603 are provided in the secondary transfer unit 41. FIG. 7A is a schematic side view of the periphery of the driving roller 400, and FIG. 7B is a front view of the periphery of the driving roller 400. FIG. 8 is a schematic view of the periphery of the driving roller 400 along the radial direction of the driving roller 400. In FIGS. 7A, 7B and 8, the second blade facing roller 505 and the second blade 506 illustrated in FIG. 3 are omitted, and the first blade facing roller 403 is disposed upstream of the driving roller 400 in the running direction of the secondary transfer belt 36. Unit cases 604 and 605 illustrated in FIG. 8 are members that support the driving roller 400 and the holding member 606.

Here, the abutting member 603 is disposed so as to push the secondary transfer belt 36 inward with respect to the outer peripheral surface of the secondary transfer belt 36 in the vicinity of the contact start point S at which the guide 601 comes into contact with the regulating member 602 (so that the secondary transfer belt 36 passes through an inner side than the tangent line of the driving roller 400 and the first blade facing roller 403 indicated by the dashed line in FIG. 7A). The abutting member 603 is disposed so as to push the secondary transfer belt 36 inward with respect to the outer peripheral surface of the secondary transfer belt 36 in the vicinity of the contact start point S. Such an arrangement allows the abutting member 603 to be disposed so as to be pressed against the vicinity of a point at which a perpendicular line drawn from the contact start point S to a tangent line of the driving roller 400 and the first blade facing roller 403 intersects the outer peripheral surface of the secondary transfer belt 36.

The vicinity of the contact start point S at which the guide 601 comes into contact with the regulating member 602 is within 3 mm on each of upstream and downstream of the contact start point S in the running direction of the secondary transfer belt 36. A more preferable position at which the abutting member 603 is disposed is within 3 mm downstream of the contact start point S in the running direction of the secondary transfer belt 36.

The abutting member 603 is preferably disposed between a winding start point M at which the driving roller 400 starts to be wound around the secondary transfer belt 36 and the contact start point S in the running direction of the secondary transfer belt 36.

In a case in which the second blade facing roller 505 (see FIGS. 3A and 3B) and the like, which are omitted in the embodiment illustrated in FIGS. 7A, 7B and 8, are provided, when the secondary transfer belt 36 is pressed inward by the abutting member 603, the abutting member 603 is disposed so as to form a trajectory along which the secondary transfer belt 36 passes through the inner side than a tangent line between the driving roller 400 and the second blade facing roller 505. Further, in this case, the position to which the abutting member 603 is pressed is in a vicinity of a point at which a perpendicular line drawn from the contact start point S to the tangent line of the driving roller 400 and the second blade facing roller 505 intersects the outer peripheral surface of the secondary transfer belt 36.

According to the secondary transfer unit 41 of the present embodiment, since the abutting member 603 is provided in the vicinity of the contact start point S, the movement of the guide 601 outward in the radial direction of the driving roller 400 is regulated by the contact friction between the guide 601 and the regulating member 602. Therefore, the guide 601 can be prevented from riding on the regulating member 602. Further, since the pulsation of the guide 601 can also be prevented, generation of shavings caused by the friction between the guide 601 and the regulating member 602 can also be restrained. In addition, since the secondary transfer belt 36 is pressed by the abutting member 603 and the secondary transfer belt 36 is stretched between the regulating member 602 and the abutting member 603, flapping of the secondary transfer belt 36 during running (vibration in a direction perpendicular to the running direction of the secondary transfer belt 36) is restrained, and rubbing between the guide 601 and the regulating member 602 due to the flapping of the secondary transfer belt 36 can be prevented.

The abutting member 603 is rotatably held. Accordingly, when the secondary transfer belt 36 and the abutting member 603 come into contact with each other, the abutting member 603 rotates in accordance with the running of the secondary transfer belt 36. That is, since friction between the secondary transfer belt 36 and the abutting member 603 is restrained, wear of the secondary transfer belt 36 and the abutting member 603 can be reduced. Typically, a conventional abutting member is relatively large in size and has a large contact area with a belt, for example, as in a case of a crank-shaped abutting member that contacts an outer peripheral surface of a belt at three different positions. In the present embodiment, since the contact area of the abutting member 603 with the secondary transfer belt 36 is small, wear between the secondary transfer belt 36 and the abutting member 603 is reduced compared to the conventional abutting member.

The secondary transfer belt 36, the guide 601, the driving roller 400, the regulating member 602, the first blade facing roller 403, and the abutting member 603 according to the present embodiment are specifically described. The secondary transfer belt 36 is an endless belt formed of polyimide resin having a thickness of 80 μm, and the guide 601 is formed of silicone rubber having a thickness of 2 mm and a width of 5 mm fixed to the inner circumferential surface of the secondary transfer belt 36 over the entire circumference. The driving roller 400 is a roller having an outer diameter of 30 mm and the surface of the driving roller 400 is coated with ethylene propylene rubber. The regulating member 602 is a collar having an outer diameter of 30 mm formed of polyacetal resin. The first blade facing roller 403 is a roller having an outer diameter of 20 mm formed of stainless steel. The abutting member 603 is a roller having an outer diameter of 13 mm formed of polyacetal resin. The abutting member 603 presses the secondary transfer belt 36 inward by 0.5 mm. The above-described materials, numerical values, and the like are merely examples, and the present disclosure is not limited thereto.

Further, as illustrated in FIGS. 7B and 8, the abutting member 603 of the present embodiment is in contact with the outer peripheral surface of the secondary transfer belt 36 at a position overlapping with both the axially outer end of the driving roller 400 in the regulating member 602 and the axially inner end of the driving roller 400 in the guide 601. Accordingly, the secondary transfer belt 36 can be prevented from being damaged as described below.

Figure 9A:
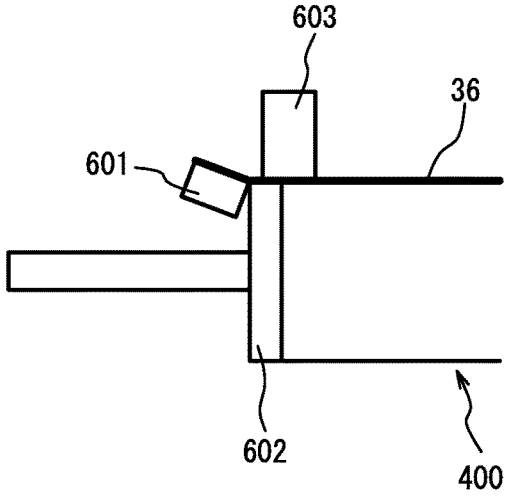
FIGS. 9A and 9B are diagrams of a schematic configuration of a phenomenon in which a belt bends.
Figure 9B:
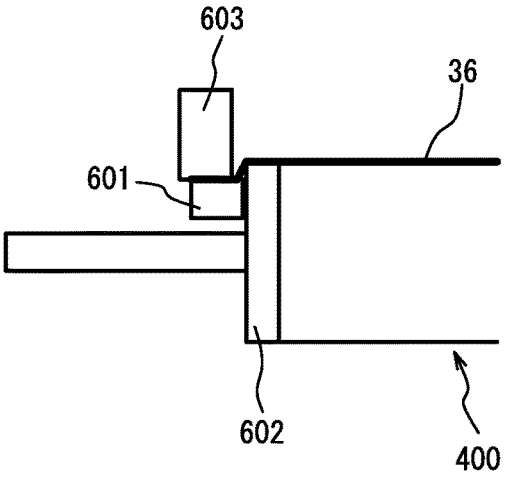

Here, with reference to FIGS. 9A and 9B, a description is given of a disadvantage in a case in which the abutting member 603 is not provided at a position overlapping both the outer end of the regulating member 602 and the inner end of the guide 601 as described above. FIG. 9A illustrates a state in which the abutting member 603 is disposed on an inner side of the secondary transfer belt 36 in the width direction than the inner end of the guide 601. In this case, when the guide 601 and the regulating member 602 come into contact with each other and the guide 601 moves outward in the radial direction of the driving roller 400, the end of the secondary transfer belt 36 is bent outward as illustrated in FIG. 9A, and the secondary transfer belt 36 might be damaged. Further, as illustrated in FIG. 9B, if the abutting member 603 is disposed outside the outer end of the regulating member 602 in the width direction of the secondary transfer belt 36, the guide 601 is pushed inward by the abutting member 603, and the end of the secondary transfer belt 36 is bent inward as illustrated in FIG. 9B, so that the secondary transfer belt 36 might be damaged.

On the other hand, as illustrated in FIGS. 7B and 8, in the case in which the abutting member 603 is disposed at the position overlapping both of the outer end of the regulating member 602 in the axial direction of the driving roller 400 and the inner end of the guide 601 in the axial direction of the driving roller 400, the end of the secondary transfer belt 36 is not bent and damage to the secondary transfer belt 36 can be prevented.

Figure 10:
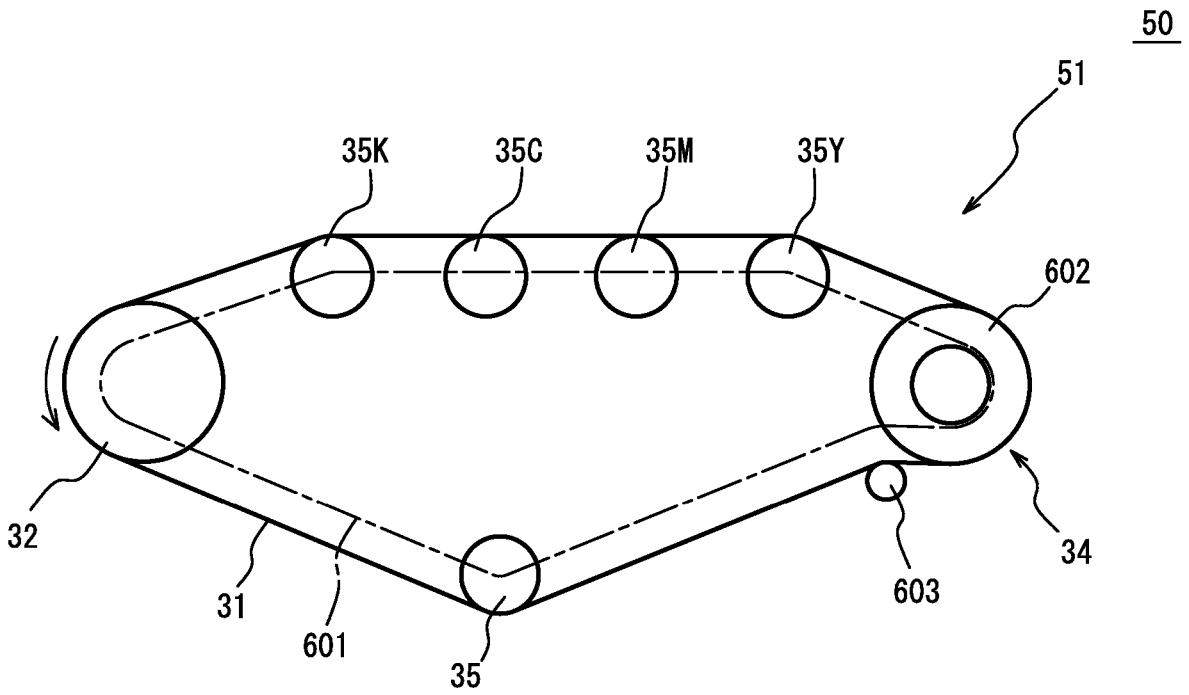
FIG. 10 is a diagram of a schematic configuration of the belt running device constituting an intermediate transfer unit.

Although the secondary transfer unit 41 uses the secondary transfer belt 36 in the above-described embodiment, a transfer device and a belt running device according to another embodiment of the present disclosure can be embodied as an intermediate transfer unit 50 and a belt running device 51 illustrated in FIG. 10. The belt running device 51 includes guides 601, primary transfer rollers 35Y, 35M, 35C, and 35K, a driving roller 32, a secondary transfer back surface roller 35, and a cleaning backup roller 34. The guides 601 are provided at both ends of an inner peripheral surface of an intermediate transfer belt 31. The primary transfer rollers 35Y, 35M, 35C, and 35K, the driving roller 32, the secondary transfer back surface roller 35, and the cleaning backup roller 34 are provided inside a loop of the intermediate transfer belt 31. Regulating members 602 are provided at both ends of the cleaning backup roller 34. An abutting member 603 is disposed upstream of the cleaning backup roller 34 in the running direction of the intermediate transfer belt 31. The abutting member 603 is in contact with the outer peripheral surface of the intermediate transfer belt 31 so as to push the intermediate transfer belt 31 inward in the vicinity of a contact start point at which the guide 601 and the regulating member 602 start to come into contact with each other when the intermediate transfer belt 31 rotates. Also, in the intermediate transfer unit 50, the abutting member 603 can prevent the guide 601 from riding on the regulating member 602.

The transfer device and the belt running device according to the present disclosure can also be applied to a belt type fixing device in which a heating roller is provided in addition to the fixing roller and the pressure roller. Further, the transfer device and the belt running device according to the present disclosure are also applicable to a belt conveying apparatus that conveys a recording medium P in a predetermined direction by the running of a belt while bearing the recording medium P on the surface of the belt.

Figure 11:
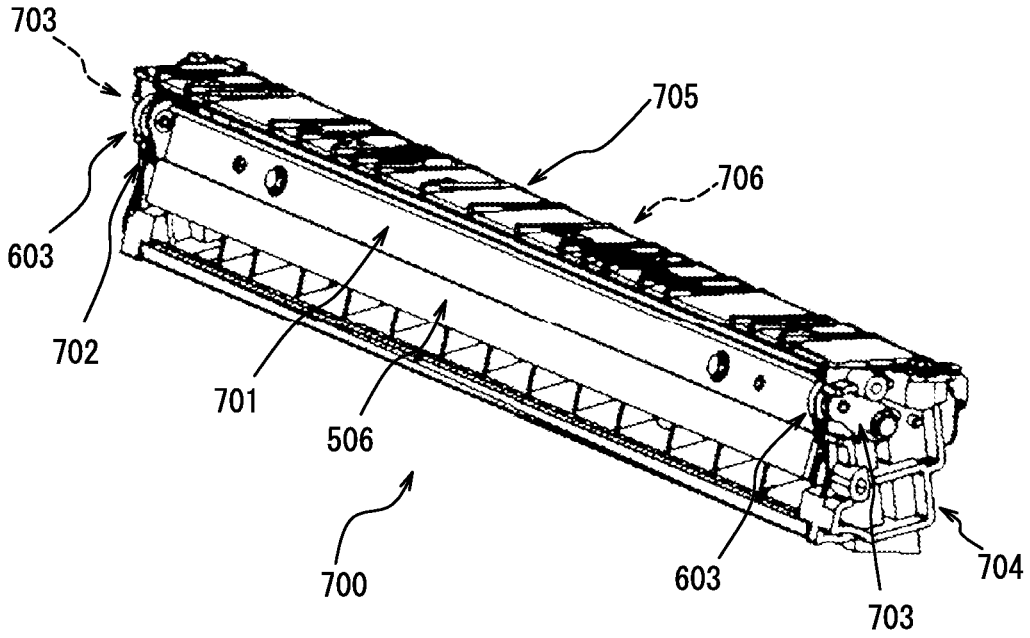
FIG. 11 is a schematic perspective view of a second cleaning unit.
Figure 12:
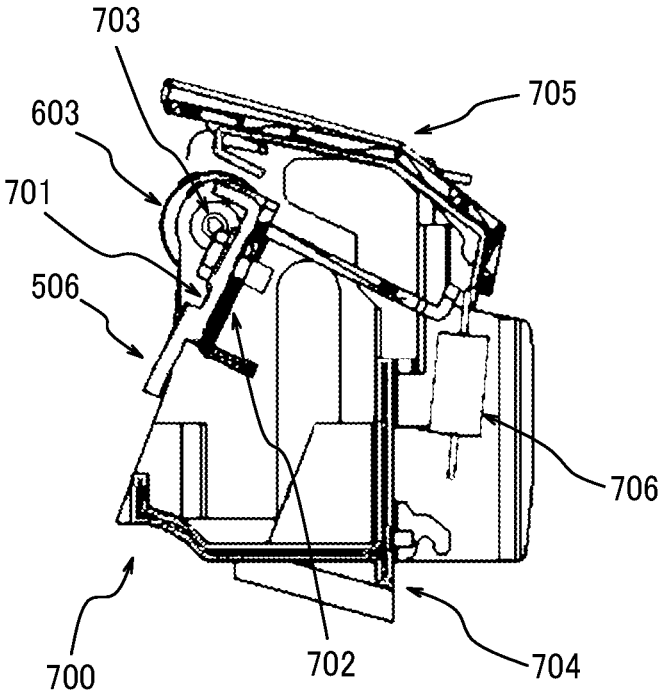
FIG. 12 is a schematic side view of the second cleaning unit.

FIGS. 11 and 12 are schematic views of the second cleaning unit 700 that includes the abutting member 603 and is used together with the secondary transfer unit 41. FIG. 11 is a perspective view of the second cleaning unit 700, and FIG. 12 is a sectional view thereof.

The second cleaning unit 700 includes a second blade 506, a blade holding member 701, a blade holder 702, blade holder holding members 703, cases 704, recording medium guide members 705, a blade spring 706, and the cylindrical (roller-shaped) abutting members 603. The second blade 506 is a rubber blade and is bonded and fixed to the blade holding member 701. The blade holding member 701 is screwed to the blade holder 702. The blade holder 702 is rotatably supported by the blade holder holding member 703 constituted of a shaft and a sheet metal. Further, the blade holder 702 is pulled by the blade spring 706, and the second blade 506 contacts the secondary transfer belt 36 illustrated in FIG. 3 with a predetermined force. The blade spring 706 is supported by the blade holder holding member 703 and a hook provided on the case 704. The blade holder holding member 703 is screwed and fixed to the case 704. A recording medium guide member 705 is provided on a recording medium conveying surface side of the case 704. The roller-shaped abutting members 603 are provided on the shaft of the blade holder holding member 703, and are used together with a support member of the blade holder 702. As described above, in the second cleaning unit 700, since the holding member 606 illustrated in FIG. 6 is used together with the support member of the blade holder 702, the number of components can be reduced.

Figure 13A:
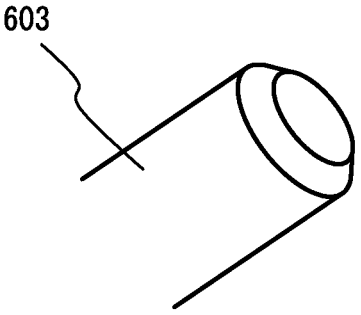
FIGS. 13A and 13B are schematic perspective views of modifications of the abutting member.
Figure 13B:
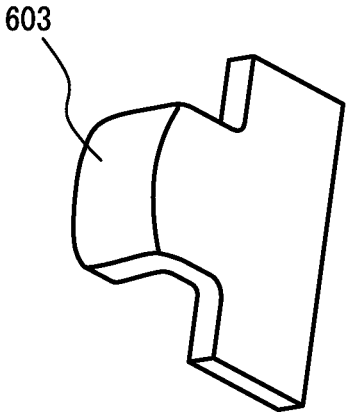

The above-described abutting members 603 have a cylindrical shape (roller shape), but as illustrated in FIG. 13A, the abutting members 603 may be constituted by a columnar shaft itself. Further, as illustrated in FIG. 13B, a part of a case, a holder member, or the like may be used as the abutting members 603 (the part may be also bent to form the abutting members 603). For example, the case is the unit case 604 of FIG. 8, and the holder member is the holding member 606 of FIG. 8.

Figure 14A:
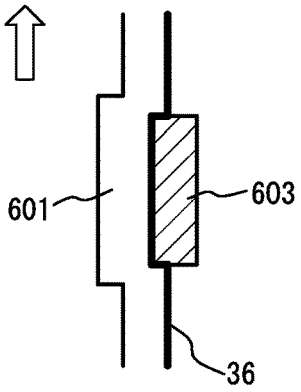
FIGS. 14A and 14B are schematic cross-sectional views of a comparative example and a modification, respectively, of the abutting member.
Figure 14B:
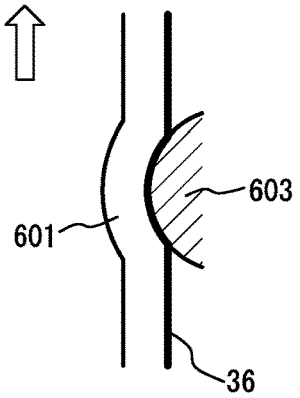

The abutting members 603 may have various shapes, but preferably have a shape that smoothly bites into the secondary transfer belt 36 (a shape that has no sharp portion in the running direction of the secondary transfer belt 36 and is smooth like an arc). For example, as in the abutting member 603 illustrated in FIG. 14A, if there is a sharp portion (a portion bent at a right angle in the illustrated example) with respect to the running direction of the secondary transfer belt 36 (the direction indicated by the arrow in FIG. 14A), the secondary transfer belt 36 may be locally bent and damaged. On the other hand, as illustrated in FIG. 14B, the abutting member 603 is smoothly bent with respect to the running direction of the secondary transfer belt 36, local bending of the secondary transfer belt 36 is alleviated, and thus damage can be prevented.

The image forming apparatus according to the present disclosure can be applied to various apparatuses such as a printer, a facsimile, a copying machine, and a multifunction peripheral. In addition, the recording medium P may be any of various types of sheet (for example, thick paper, a postcard, an envelope, plain paper, thin paper, coated paper (coated paper, art paper, or the like), tracing paper, or the like), or may be any sheet-shaped material capable of forming an image, such as an OHP sheet, an OHP film, or a resin film.

Although some embodiments of the present disclosure have been described above, the present disclosure is not limited to such specific embodiments, and various modifications and changes can be made within the scope of the gist of the present disclosure described in the claims unless otherwise specified in the above description. The effects described in the embodiment of the present disclosure are merely examples of the effects produced by the present disclosure, and the effects of the present disclosure are not limited to those described in the embodiment of the present disclosure.

The suffixes Y, M, C, and K attached to each reference numeral indicate only that components indicated thereby are used for forming yellow, magenta, cyan, and black images, respectively, and hereinafter may be omitted when color discrimination is not necessary.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present disclosure.

What is claimed is:

1. A belt running device comprising:

a plurality of rollers;

a belt wound around the plurality of rollers and configured to rotate;

a guide provided at an end of an inner peripheral surface of the belt;

a regulating member provided at an end of at least one roller of the plurality of rollers in an axial direction of the at least one roller and configured to contact the guide and regulate a movement of the belt in the axial direction of the at least one roller; and an abutting member configured to contact an outer peripheral surface of the belt to press the belt inward in a vicinity of a contact start point at which the guide and the regulating member start to contact when the belt runs, wherein the belt is a transfer belt configured to bear a toner image onto the outer peripheral surface of the transfer belt.

2. The belt running device according to claim 1, wherein the belt is configured to start to be wound around the at least one roller at a winding start point in a direction of rotation of the belt, and wherein the abutting member is configured to contact the outer peripheral surface of the belt at a position downstream of the contact start point and upstream of the winding start point in a direction of rotation of the belt.

3. The belt running device according to claim 1, wherein an outer peripheral surface of the abutting member has a cylindrical shape and the abutting member is rotatably disposed.

4. The belt running device according to claim 1, further comprising a case configured to support the plurality of rollers, wherein the abutting member is a bent part of the case or a bent part of a holder member provided in the case.

5. The belt running device according to claim 1, wherein the abutting member is configured to contact the outer peripheral surface of the belt at a position overlapping with both an outer end of the regulating member in the axial direction of the at least one roller and an inner end of the guide in the axial direction of the at least one roller.

6. A transfer device comprising the belt running device according to claim 1, wherein the belt is a secondary transfer belt configured to contact a toner image bearing surface of an intermediate transfer belt, which is configured to bear a toner image on an outer circumferential surface of the intermediate transfer belt, to form a transfer nip.

7. The transfer device according to claim 6, further comprising:

a blade configured to contact a surface of the belt;

a blade holder configured to hold the blade; and a blade holder holding member configured to rotatably support the blade holder, wherein the abutting member is secured on a shaft of the blade holder holding member.

8. An image forming apparatus comprising the transfer device according to claim 6.

9. An image forming apparatus comprising the belt running device according to claim 1.

10. A belt running device comprising:

a plurality of rollers;

a belt wound around the plurality of rollers and configured to rotate;

a guide provided at an end of an inner peripheral surface of the belt;

a regulating member provided at an end of at least one roller of the plurality of rollers in an axial direction of the at least one roller and configured to contact the guide and regulate a movement of the belt in the axial direction of the at least one roller; and an abutting member configured to contact an outer peripheral surface of the belt to press the belt inward in a vicinity of a contact start point at which the guide and the regulating member start to contact when the belt runs, wherein an outer peripheral surface of the abutting member has a cylindrical shape and the abutting member is rotatably disposed.

11. A belt running device comprising:

a plurality of rollers;

a belt wound around the plurality of rollers and configured to rotate;

a guide provided at an end of an inner peripheral surface of the belt;

a regulating member provided at an end of at least one roller of the plurality of rollers in an axial direction of the at least one roller and configured to contact the guide and regulate a movement of the belt in the axial direction of the at least one roller; and an abutting member configured to contact an outer peripheral surface of the belt to press the belt inward at a position downstream of a contact start point at which the guide and the regulating member start to contact when the belt runs and upstream of a winding start point in a direction of rotation of the belt, wherein the belt is configured to start to be wound around the at least one roller at the winding start point in a direction of rotation of the belt.

* * * * *